US010077964B2

(12) United States Patent
Summers

(10) Patent No.: US 10,077,964 B2
(45) Date of Patent: Sep. 18, 2018

(54) ARCHERY ACCESSORY COUPLER AND METHOD

(71) Applicant: Daniel A. Summers, Alpine, WY (US)

(72) Inventor: Daniel A. Summers, Alpine, WY (US)

( * ) Notice: Subject to any disclaimer, the term of this patent is extended or adjusted under 35 U.S.C. 154(b) by 0 days.

(21) Appl. No.: 15/809,349

(22) Filed: Nov. 10, 2017

(65) Prior Publication Data

US 2018/0087866 A1 Mar. 29, 2018

Related U.S. Application Data

(63) Continuation of application No. 15/247,456, filed on Aug. 25, 2016, now Pat. No. 9,829,270.

(60) Provisional application No. 62/209,519, filed on Aug. 25, 2015.

(51) Int. Cl.
*F41B 5/14* (2006.01)
*F41B 5/22* (2006.01)

(52) U.S. Cl.
CPC ..... *F41B 5/1403* (2013.01); *F41B 5/14* (2013.01); *F41B 5/143* (2013.01)

(58) Field of Classification Search
CPC .... F41B 5/06; F41B 5/066; F41B 5/14; F41B 5/1426; F41B 5/143
See application file for complete search history.

(56) References Cited

U.S. PATENT DOCUMENTS 5,289,814 A 3/1994 Maisano
5,341,791 A * 8/1994 Shafer ..... F41G 1/345 124/87
5,372,119 A * 12/1994 Kidney ..... F41B 5/143 124/41.1
5,379,746 A * 1/1995 Sappington ..... F41G 1/467 124/86
5,507,272 A * 4/1996 Scantlen ..... F41G 1/467 124/87
6,557,541 B2 * 5/2003 Pinto, Jr. ..... F41B 5/143 124/24.1
7,464,908 B2 * 12/2008 Files ..... F41B 5/066 124/86
7,775,201 B2 8/2010 Cooper
8,065,994 B2 * 11/2011 Holmberg ..... A01M 31/004 124/86
8,342,161 B2 * 1/2013 Harwath ..... F41B 5/143 124/41.1
8,505,527 B2 * 8/2013 Kempf ..... F41B 5/066 124/86
8,839,772 B2 * 9/2014 Lee ..... F41B 5/066 124/86

OTHER PUBLICATIONS

Hoyt Integra Direct Sight Manual Excerpt; "Hoyt Integra Direct Sight Mounting;" Dated on or Before Aug. 24, 2015; 1 page.

(Continued)

*Primary Examiner* — John Ricci
(74) *Attorney, Agent, or Firm* — Barclay Damon LLP

(57) ABSTRACT

An archery accessory coupler and method for coupling a bow accessory to an archery bow is described. The archery accessory coupler, in one embodiment, includes an accessory support configured to support an accessory, and the coupler includes a body coupled to the accessory support. The archery accessory coupler facilitates vertical adjustment of the bow accessory relative to the bow.

9 Claims, 18 Drawing Sheets

(56) References Cited

OTHER PUBLICATIONS

"Hoyt Intensity Bow and Integra Sight Mount;" Dated on or Before Aug. 24, 2015; retrived from the Internet: https://www.popscreen.com/prod/MTI2MTM4ODY5/Hoyt-USA-Intensity-Compound-Bow-with-Integra-Sight-eBay; 1 page.
Hoyt Bow User Manual; "Table of Contents;" Dated on or Before Aug. 24, 2015; 23 pages.
Trophy Ridge; "Vertical Drop Away Arrow Rest Manual;" Dated on or Before Apr. 11, 2015; 2 pages.
Hunter's Friend; "Bow Sight Selection Guide—Archery Help—Hunter's Friend;" Feb. 12, 2007; retrieved from the Internet ,https://www.huntersfriend.com/archery-help/bow-sight-selection-guide.html; 3 pages.

* cited by examiner

ARCHERY ACCESSORY COUPLER AND METHOD

CROSS-REFERENCE TO RELATED APPLICATIONS

This application is a continuation application of and claims the benefit and priority of, U.S. patent application Ser. No. 15/247,456 filed on Aug. 25, 2016, which is a non-provisional of U.S. Provisional Patent Application No. 62/209,519 filed on Aug. 25, 2015. The entire contents of such applications are hereby incorporated by reference.

BACKGROUND

Different ways have been used to attach accessories, such as arrow rests and sights, to archery bows. In one way, a known arrow rest is screwed onto the bow riser using a screw inserted in a preexisting hole through the side of the bow. In another way, a known arrow rest is adhesively attached to the side of the bow. These known arrow rests have several disadvantages. With both arrow rests, it is difficult or cumbersome to adjust the position of the arrow rest after it's installed. Also, the adhesion is subject to failure after prolonged use and wear and tear of the bow, causing the known adhesive arrow rest to unexpectedly detach. Additionally, the known arrow rests are not designed to be conveniently uninstalled and reinstalled. Consequently, many users keep the known arrows rests installed while transporting their bows. As a result, transportation forces and contact with other objects can cause the orientation of the arrow rests on the bows to become unintentionally changed or misaligned.

In another approach, a known sight is mounted to a bow using a rigid mount. The riser of this bow has a groove on its side. The rigid mount has a lip that fits into the groove. Because of the looseness between the lip and groove, this known sight has a locking screw which extends through the rigid mount until it strikes the face of the bow riser. The user can vertically adjust this known sight by sliding the rigid mount along the groove and tightening the locking screw when the desired position is reached.

However, this known sight has several disadvantages. For example, the tightening of the locking screw forms a significant gap between the face of the riser and the rigid mount. Also, end of the locking screw generates a point force acting on the face of the riser. This gap and this point force can cause instability of the known sight on the riser. The point force, for example, can cause a wobbling effect based on the looseness between the lip and groove. Also, this gap can enable problematic vibrations to transmit from the bow to the known sight. These dynamic factors can impede the user's ability to fine tune his/her bow and to achieve, repeatable, optimal shooting performance. Likewise, these factors can impair the performance of the known sight, resulting in a detriment to shooting accuracy.

The foregoing background describes some, but not necessarily all, of the problems, disadvantages and shortcomings related to attaching bow accessories to bows.

SUMMARY

In an embodiment, a bow accessory coupler is described. The bow accessary coupler includes an accessory support configured to support an accessory and a mount connected to the accessory support. The mount is configured to be mounted to a riser of an archery bow and the riser includes a riser portion. The mount is configured to be transitioned from an adjustment condition in which the mount is moveable relative to the riser portion to a securing condition in which the mount is secured to the riser portion. The mount includes a plurality of riser engagers configured to be coupled to the riser portion. The plurality of riser engagers is configured to be flexed between a first arrangement and a second arrangement. The mount defines a flex space located between the riser engagers. In the first arrangement, the flex space has a first dimension and in the second arrangement, the flex space has a second dimension. The first arrangement is associated with the adjustment condition and the second arrangement is associated with the securing condition. A fastener is configured to be coupled to the mount so as to set the mount in the securing condition.

DETAILED DESCRIPTION

Figure 1:
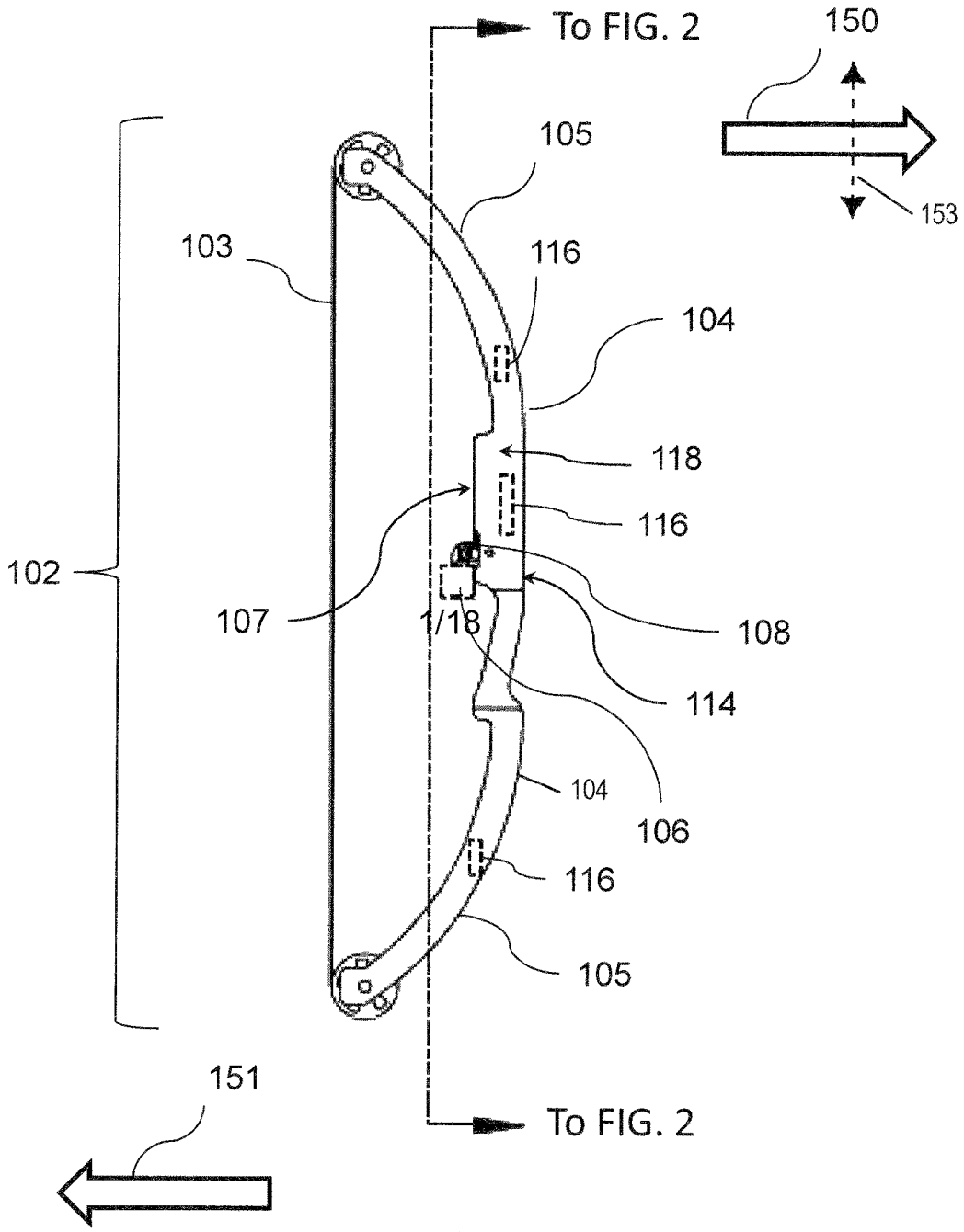
FIG. 1 is a side view of an archery bow having an embodiment of an accessory mount coupled to the bow riser.
Figure 2:
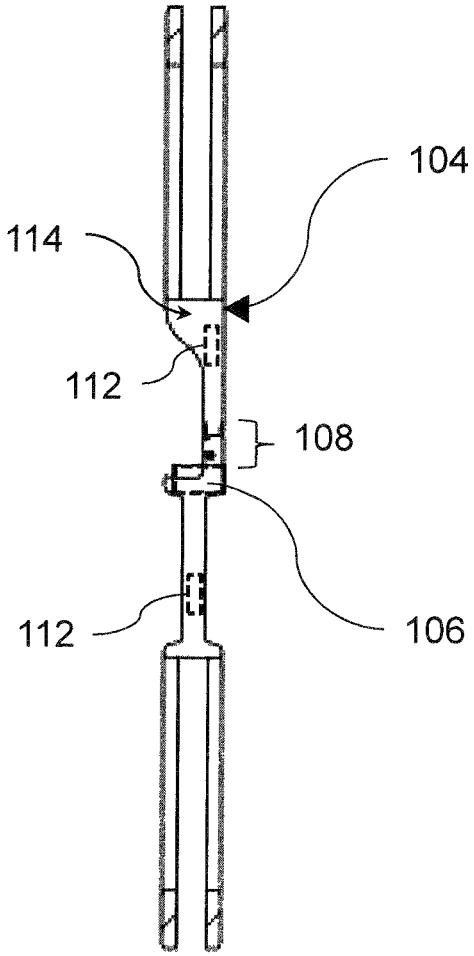
FIG. 2 is a front view of the archery bow of FIG. 1.
Figure 3:
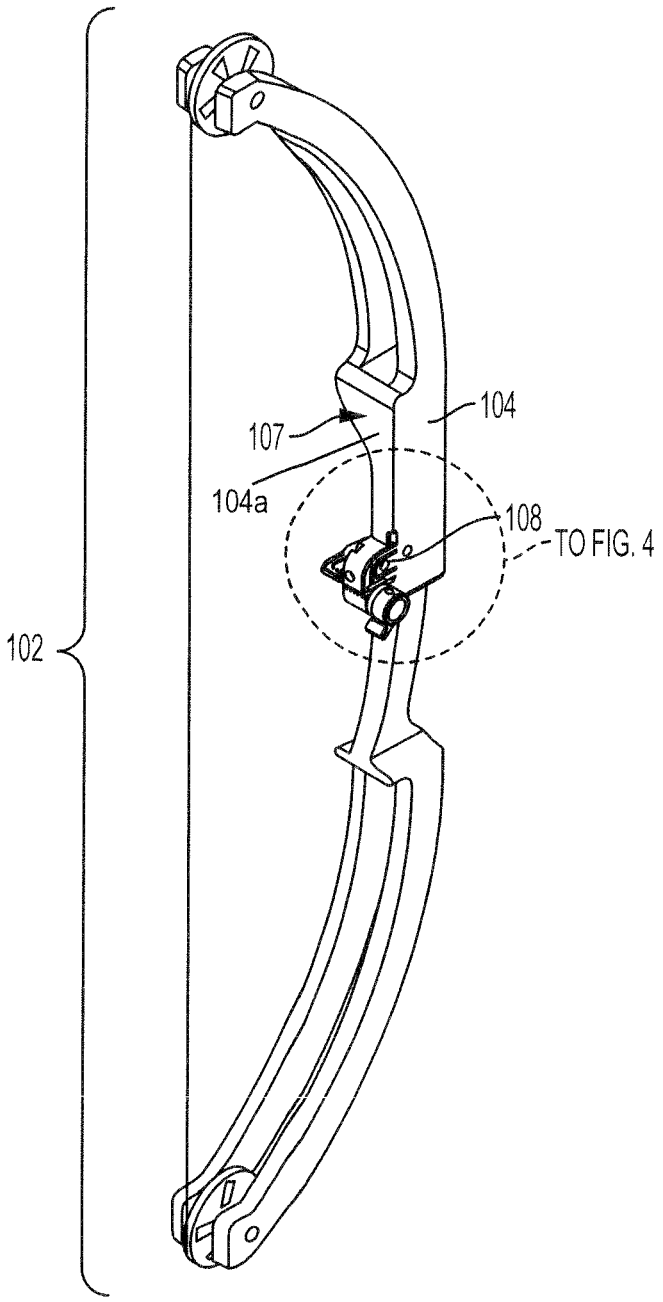
FIG. 3 is a rear isometric view of the archery bow of FIG. 1, showing another embodiment of an accessory mount coupled to the riser of the archery bow.

As illustrated in FIGS. 1-3, in one embodiment, an archery bow 102 includes a bowstring 103 coupled to limbs 105. The limbs 105 are coupled to a bow riser or riser 104.

A bow accessory or accessory 106 can be attached or coupled to the bow 102 via an attachment or bow accessory coupler 108. For example, the accessory 106 can be coupled to the riser 104 via the bow accessory coupler 108. The accessory 106 can be any suitable type of accessory, including, but not limited to, an arrow rest or arrow holder configured to support an arrow, a sight device configured to aid in aiming, a light holder configured to support a light source, a flashlight, a power cable guide, a vibration dampener or other shooting aids or bow attachments.

Figure 4:
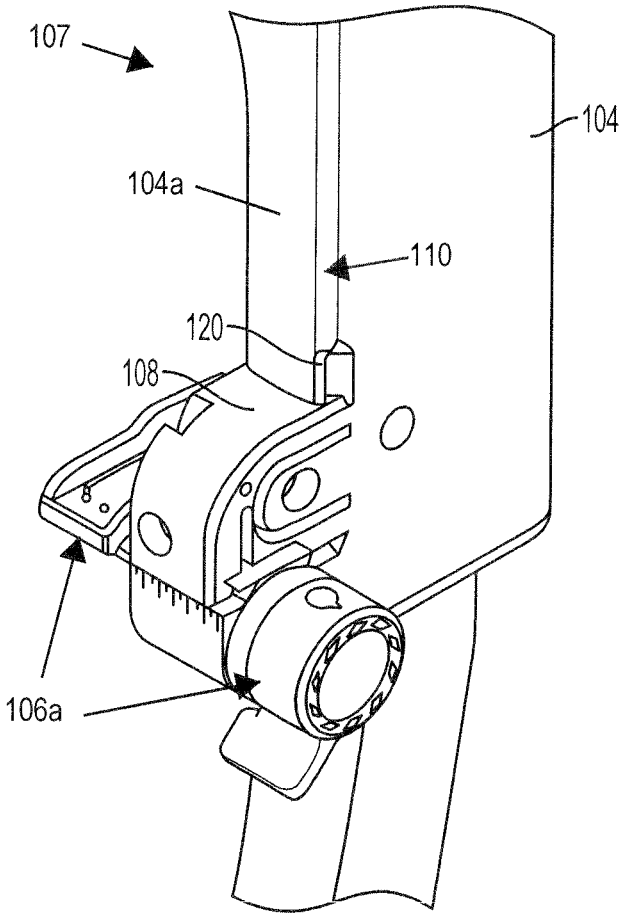
FIG. 4 is an enlarged view of the archery bow of FIG. 3.

As illustrated by FIGS. 1, 2 and 4, the bow 102 has one or more accessory mating or accessory coupling structures or surfaces, such as: (a) rear face coupling structure 104*a* and/or rear edge coupling structure 110 located on or near the rear side 107 of the bow 102; (b) front face coupling structure 112 and/or front edge coupling structure 104*b* located on or near the front side 114 of the bow 102; and (c) side coupling structures 116 located on either of the right or left sides 118 of the bow 102. In one embodiment, each of the coupling structures 19, 111, and 116 has, defines or incorporates a slot, groove, track, slide surface, slide director, notch, rail, or protrusion, such as protrusion 120 (FIG. 4), defining a vertical adjustment zone as described below. The bow accessory coupler 108 can be coupled to any of the coupling structures 104*a*, 104*b*, 19, 111, and 116.

Figure 5A:
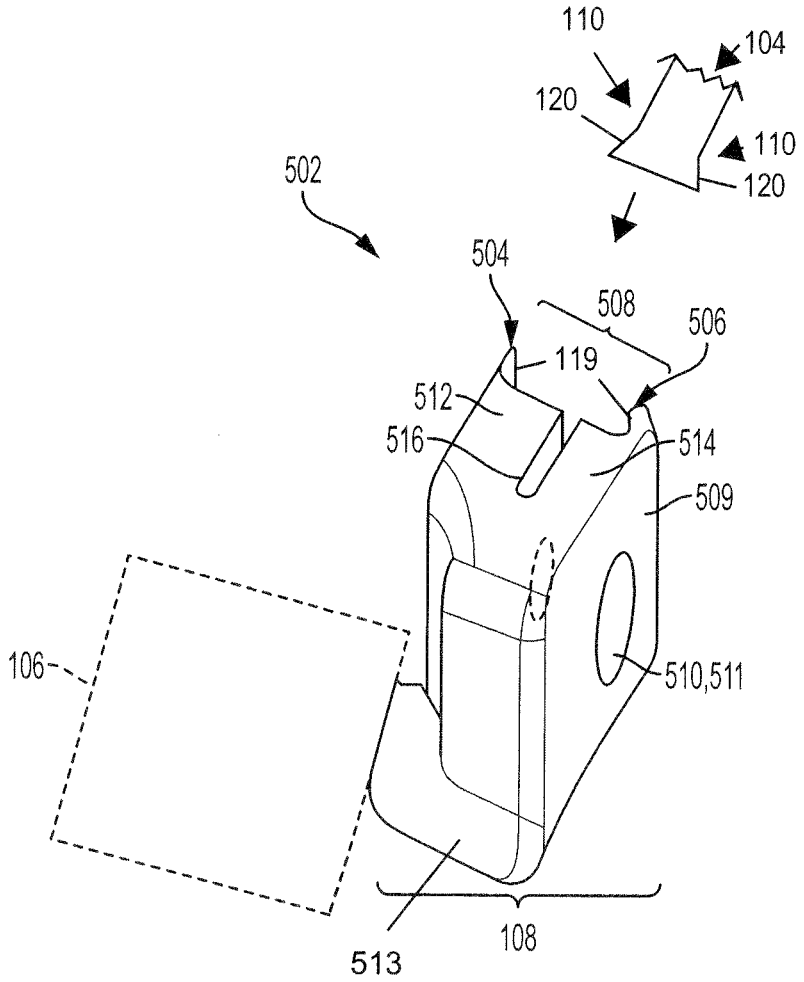
FIG. 5*a* is an isometric view of yet another embodiment of an accessory mount for an archery bow.

Referring to FIG. 1, when the bow 102 is positioned upright for operation, the front face 114 of the bow 102 faces in a forward or shooting direction 150 toward a target (not shown). The rear face 107 of the bow 102 is positioned facing the user, in a rearward direction 151 opposite the shooting direction 150. Also, the riser 104 of the bow 102 generally extends vertically and substantially parallel to a vertical axis 153. As illustrated by FIGS. 4 and 5*a*, the bow accessory coupler 108 can support or be coupled to an accessory such as arrow rest accessory 106*a* (FIG. 4) or accessory 106 (FIG. 5*a*). In an embodiment, the accessory 106 and the bow accessory coupler 108 can be a single, integral, monolithic object. In another example, the bow accessory coupler 108 can be removable from the accessory 106.

In an example, the accessory 106 is coupled to the bow accessory coupler 108 such that at least a portion of the accessory 106 extends in a plane that faces the target. In this embodiment, when the bow accessory coupler 108 is coupled to the riser 104 and the bow 102 is in the operational position, the accessory 106 is offset to the right or left of the bow accessory coupler 108. This offset position locates the accessory 106 into the user's field of vision, line of shooting action or aiming zone to facilitate shooting.

Figure 5B:
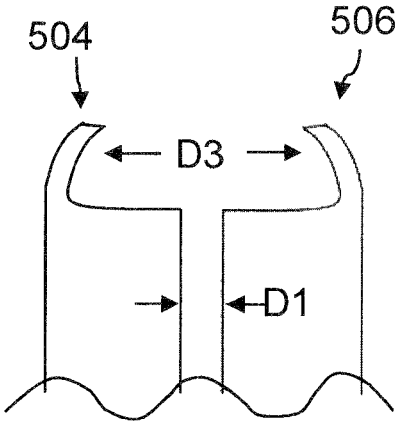
FIG. 5*b* is an illustration of the accessory mount of FIG. 5*a* in the adjustment condition.
Figure 5C:
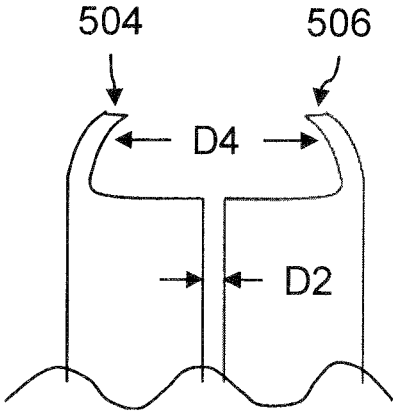
FIG. 5*c* is an illustration of the accessory mount of FIG. 5*a* in the securing condition.
Figure 13:
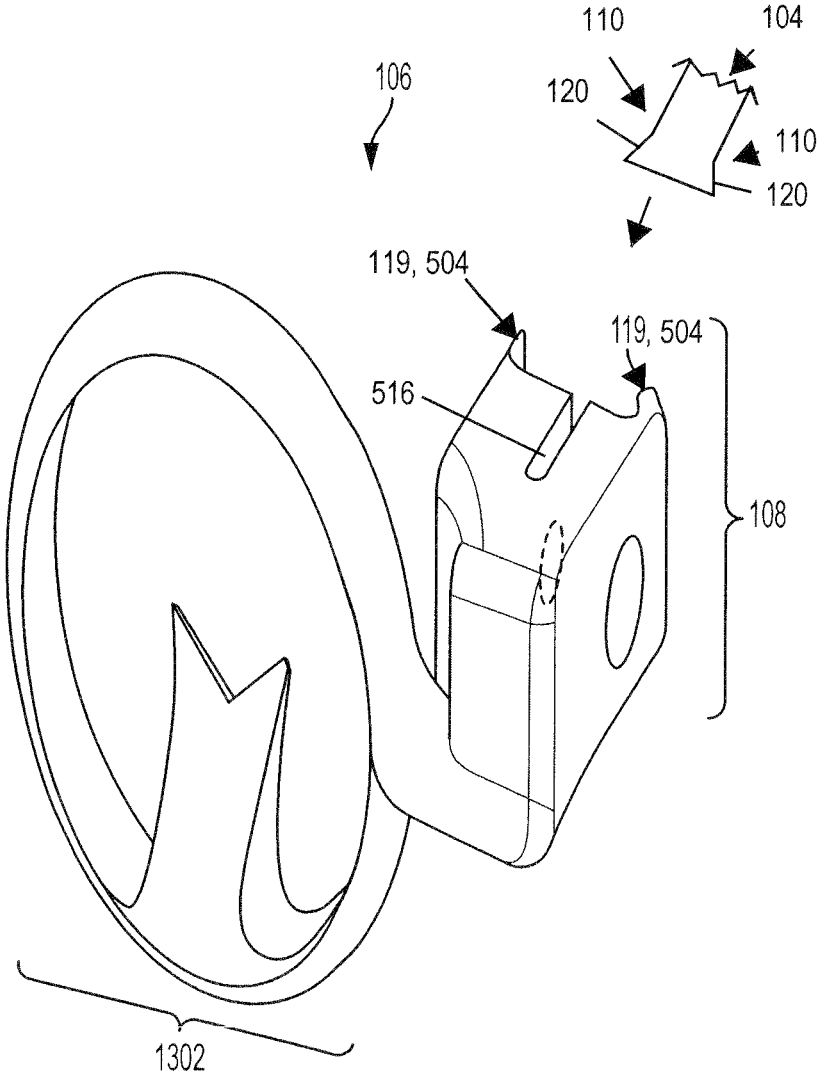
FIG. 13 is an isometric view of an embodiment of an accessory mount coupled to an arrow rest.

With particular reference to FIG. 5*a*, in an embodiment, the bow accessory coupler 108 includes a main body or mount 502 and an accessory support 513 coupled to the mount 502 and to which the accessory 106 is coupled. The mount 502 includes a plurality of flexible clamp arms or flexible clamp sections 511, 514 separated by a flex space 516. A first lateral member, rail engager, or riser engager 504 and a second lateral member, rail engager, or riser engager 506, directly opposite and parallel to the first rail engager 504, extend from the mount 502. The first riser engager 504 and the second rail engager 506 form a riser-receiving opening 508 for receiving the peak, notch, rail, or protrusion 120 (FIG. 4) of the coupling structures 104*a*, 110 of the bow 102. As illustrated by FIGS. 5*a* and 13, the first riser engager 504 and the second riser engager 506 can each include an inwardly angled lip 119 for securely engaging the dovetail-shaped rail 120 of the coupling structure 110. The riser engagers 504 and 506 are configured to be flexed, repositioned or otherwise moved relative to each other. For example, each of the riser engagers 504 and 506 is flexible so as to flex between a predisposed or adjustment position or condition and a locked or securing position or condition. In an embodiment, the flex space 516 has a first dimension D1 and a second dimension D2. In the adjustment condition illustrated in FIG. 5*b*, the engagers 504 and 506 are positioned apart by a first separation distance D3, and the flex space 516 has the first dimension D1. In the securing condition illustrated in FIG. 5*c*, the engagers 504 and 506 are inwardly flexed until they clamp upon and compress the dovetail-shaped rail 120. In this securing condition, the engagers 504 and 506 are positioned apart by a second separation distance D4, which is less than the first separation distance D3, and the flex space 516 has the second dimension D2, which is less than the first dimension D1. During the inward flexing process, the flex space 508 changes from the first dimension D1 to the second dimension D2, which is smaller than the first dimension D1. In this way, the riser engagers 504 and 506 form a clamp that clamps onto the rail or protrusion 120.

In an embodiment, when the mount 502 is secured to the riser 104, the flat surface of the mount face 503 of the mount 502 is flush against, and in contact with, the face coupling structure 104*a*. This face-to-face engagement enhances the stability of the mount 502 on the riser 104.

In an embodiment, the bow accessory coupler 108 further includes or defines an opening or a bore 510 that penetrates through the mount 502 perpendicular to the first and second riser engagers 504 and 506. The bore 510 can receive a fastener (not shown) for moving the first riser engager 504 closer to the second riser engager 506 to secure the bow accessory coupler 108 to the riser 104. The fastener can be any suitable type of fastener, including, but not limited to, a screw, bolt, spring or pin. In one embodiment, the fastener is a threaded bolt, and the bore wall 511 of one, but not both, of the clamp sections 511, 514 is threaded. In operation, referring to FIG. 5*a*, the user slides the body or mount 502 onto the dovetail-shaped rail 120. Then, the user inserts the bolt into the bore 510 until the head of the bolt abuts the face 509 of the clamp section 514. Then, the user screws the bolt which engages the threads of the bore wall 511. This brings the clamp sections 511, 514 together which squeeze the dovetail-shaped rail 120 to establish a fixed or locked position on the bow 102. Due to the vertical adjustment zone of the dovetail-shaped rail 120, the user can adjust the vertical position of the bow accessory coupler 108 on the bow 102 by slightly unscrewing the bolt, repositioning the coupler 108 upward or downward, such as by sliding, and then screwing the bolt. Furthermore, in this embodiment, neither such fastener nor any other fastener makes direct physical contact with the riser 104. Instead, such fastener physically contacts the mount 502 to control the movement of the riser engagers 504 and 506.

Figure 5D:
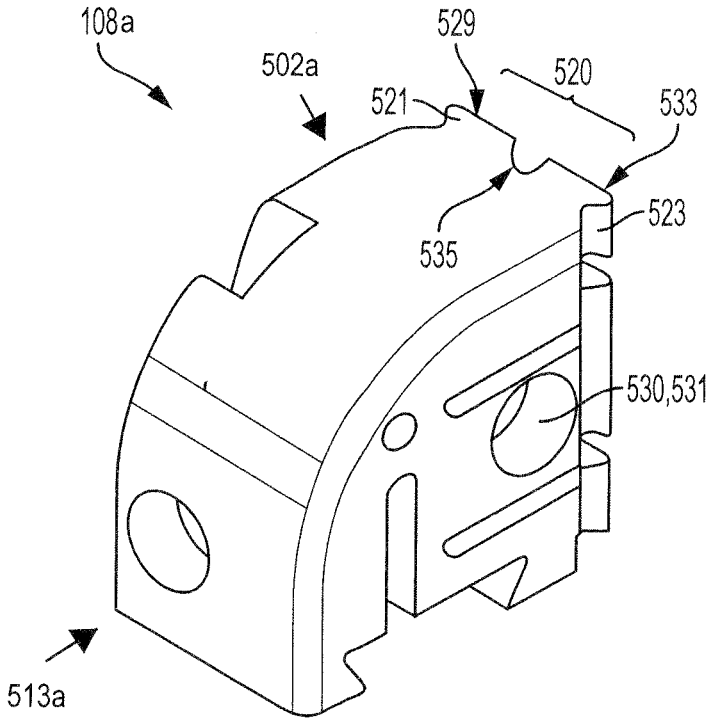
FIG. 5*d* is an isometric view of another embodiment of an accessory mount for an archery bow.
Figure 5E:
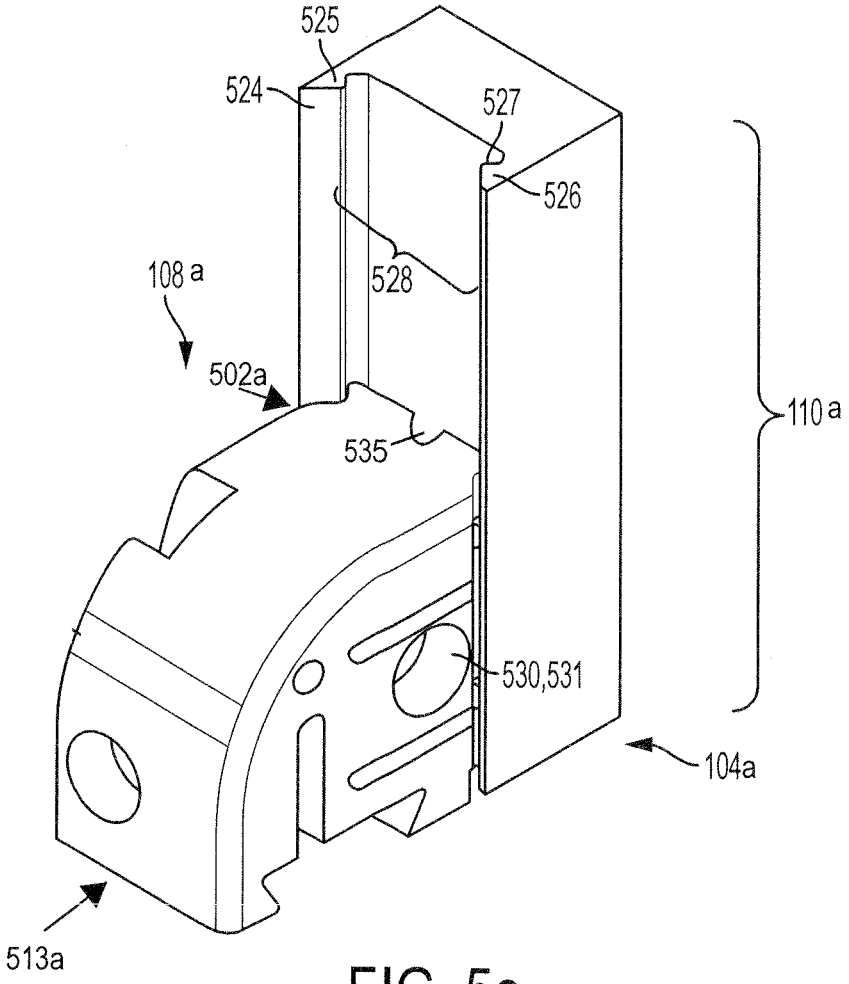
FIG. 5*e* is an isometric view of the accessory mount of FIG. 5*b* coupled to a portion of an archery bow riser.
Figure 5F:
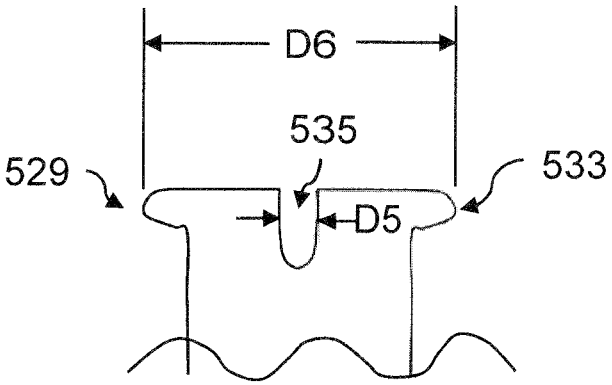
FIG. 5*f* is an illustration of the accessory mount of FIGS. 5*d*-5*e* in the adjustment condition.
Figure 5G:
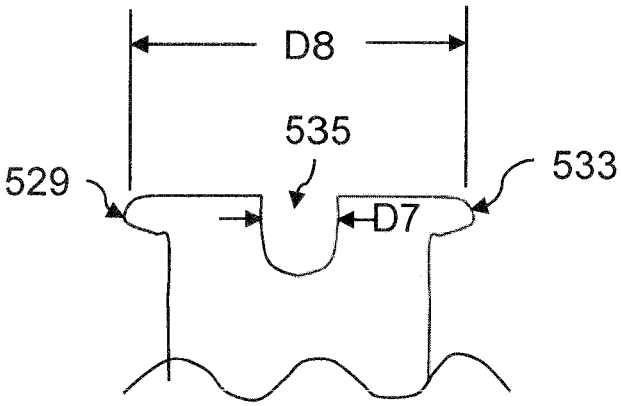
FIG. 5*g* is an illustration of the accessory mount of FIGS. 5*d*-5*e* in the securing condition.

In another embodiment, illustrated by FIGS. 5*d*-5*e*, the bow accessory coupler 108*a* includes a mount 502*a* and an accessory support 513*a* to which an accessory (not shown) is coupled. The mount 502*a* includes a dovetail-shaped protrusion, split peak, split notch, split insert or split rail 520. The split rail 520 has a rail section or riser engager 529 and a rail section or riser engager 533. The riser engager 529 has a first outwardly-angled lip 521, and riser engager 533 has a second outwardly-angled lip 523. The split rail 520 is configured to be inserted into the slot 528 of a bow riser 104*a* for securely engaging the coupling structure 110*a* of the bow riser 104*a*. The mount 502*a* defines a longitudinal flex space 535 between the rail sections 529 and 533. In this example, the mount 502*a* is configured to flex between a predisposed or adjustment position or condition and a locked or securing position or condition. In the adjustment condition illustrated in FIGS. 5*d* and 5*f*, the flex space 535 has a relatively small dimension D4, and the engagers 528, 530 are separated by a relatively small separation distance D6. In the securing condition, illustrated by FIGS. 5*e* and 5*g*, the rail lips 521, 523 of the bow accessory coupler 108 are outwardly flexed until they apply a force to the mount engagers or lips 524, 526 of the riser coupling structure 110. During the outward flexing, the flex space 535 increases to dimension D6, and the engagers 528, 530 are separated by separation distance D7, which is larger than separation distance D6. In this way, the split rail 520 is clamped or pressed onto the riser coupling structure 110*a*.

Referring to FIG. 5*e*, in an embodiment, the riser 104*a* has a first lateral member or mount engager 524 and a second lateral member or mount engager 526, directly opposite and parallel to the first mount engager 524. The mount engagers 524, 526 extend from the coupling structure 110*a* of the riser 104*a*. The first mount engager 524 and the second mount engager 526 form an opening 528 for receiving the split rail 520 of the bow accessory coupler 108*a*. As illustrated by FIG. 5*e*, the first mount engager 524 and the second mount engager 526 can each include an inwardly angled lip 524, 527 for securely engaging the outwardly angled lips 521, 523 of the rail 520 of the bow accessory coupler 108*a*.

In an embodiment, the bow accessory coupler 108*a* further includes or defines a fully or partially threaded opening or a bore 530 that penetrates through the mount 502 extending perpendicular to the split rail 520. The bore 530 can receive a fastener (not shown) for moving the first lip 521 of the split rail 520 outwardly and away from the second lip 523 of the split rail 520. In an example operation, the user inserts a threaded bolt or screw into the bore 530. The screw threadably engages the rail section 529 until making contact with an internal interference portion (not shown) of the rail section 531. As the user continues to rotate the screw, the screw drives the rail section 531, pushing it apart from the rail section 529. This exerts an outward clamping force on the riser engagers 524, 526 and secures the bow accessory coupler 108 to the coupling structure 110. This establishes a fixed, locked or securing condition on the bow 102. The fastener can be any suitable type of fastener, including, but not limited to, a screw, bolt, spring or pin. In one embodiment, the fastener is a set screw, and the bore wall 531 of the bore 530 is partially threaded. Furthermore, in this embodiment, neither such fastener nor any other fastener makes direct physical contact with the riser 104*a*. Instead, such fastener physically contacts the mount 502*a* to control the movement of the riser engagers 529 and 533.

To adjust the vertical position of the accessory coupler 108*a*, the user can partially unscrew the fastener from opening 530 to relieve the outward clamping or pressing force. Then, the user can adjust the vertical position of the bow accessory coupler 108*a* on the bow 102 by sliding the coupler 108*a* upward or downward relative to the riser 104*a*. After that, the user can retighten the fastener to increase the outward clamping or pressing force to re-establish the fixed or locked position.

In an embodiment not shown, the riser portions 524 and 526 of bow riser 104*a* are configured to be moved relative to each other in order to clamp the rail 520 of the bow accessory coupler 108*a*. For example, the riser portions 524, 526 can be configured to receive a fastener (not shown) for moving the first riser portion 524 closer to the second riser portion 526 to secure the rail 520 of the bow accessory coupler 108*a*.

Figure 6:
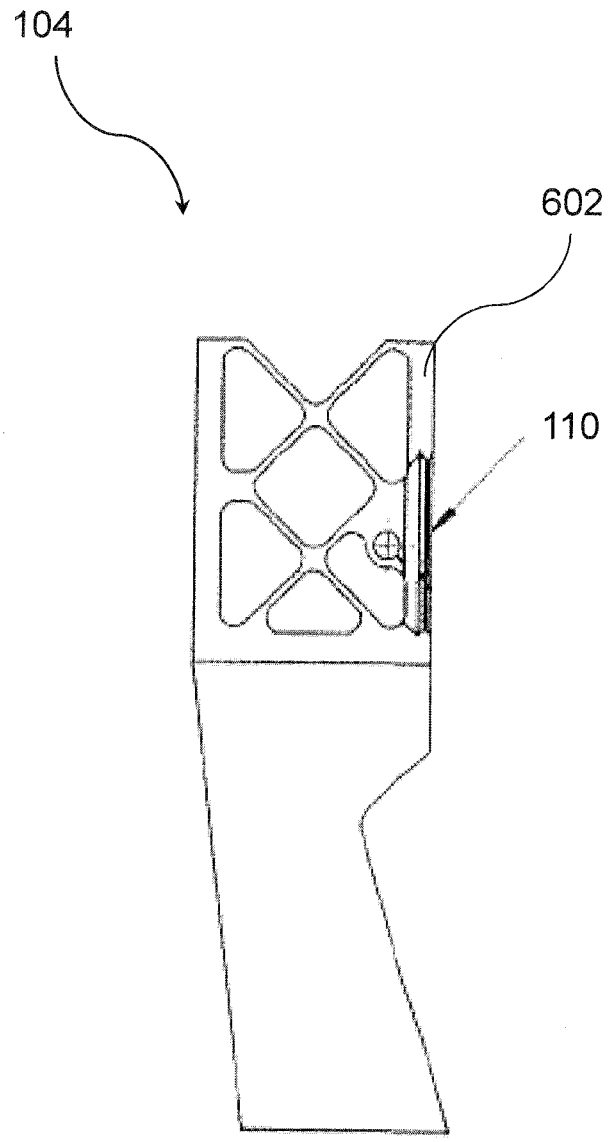
FIG. 6 is a side view of an embodiment of a portion of an archery bow riser having an accessory mount surface.
Figure 7:
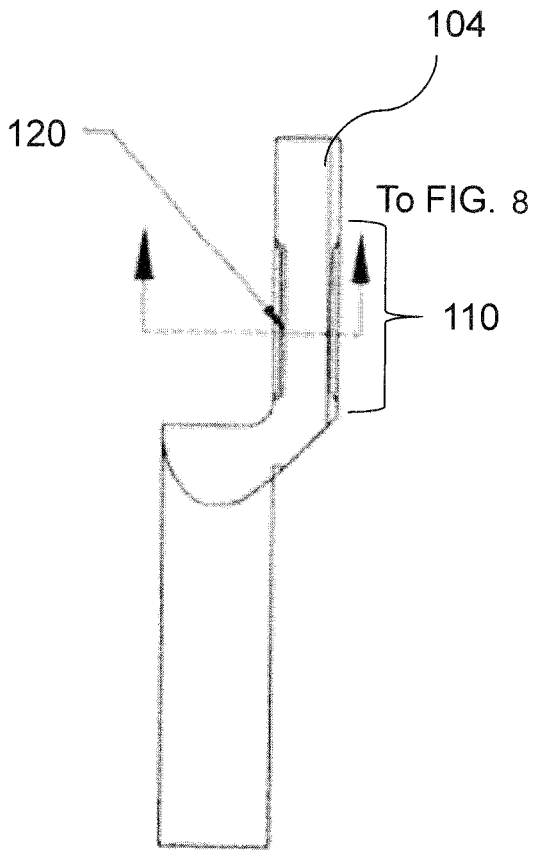
FIG. 7 is a front view of the archery bow riser of FIG. 6.
Figure 8:
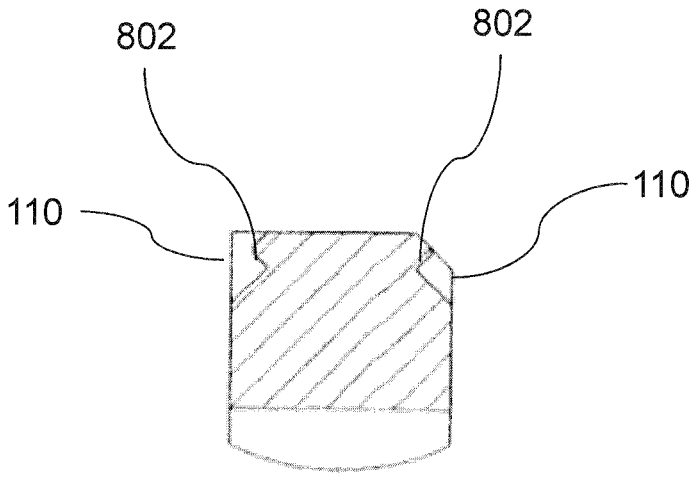
FIG. 8 is a cross-sectional view of the archery bow riser of FIG. 7, taken substantially along line 8-8.

In an embodiment, illustrated in FIGS. 6-8, the coupling structure 110 can be a point or elongated section or zone on the riser 104 for receiving the bow accessory coupler 108 (FIG. 5*a*). As illustrated in FIG. 6, the riser 104 can have a shape configured to mate with and receive the bow accessory coupler 108. For example, the track or dovetail-shaped rail 120 can be included as an element of the coupling structure 110. In another embodiment, the bow accessory coupler 108 is configured to mate with and attach to a conventional riser 104 that does not necessarily have a special shape for receiving the bow accessory coupler 108. In an embodiment, illustrated by FIG. 8, the coupling structure 110 has a dovetail shape including a notched or recessed portion for receiving the lips 119 of the first and second riser engagers 504 and 506 (FIG. 5*a*). For example, the coupling structure 110 can have a horizontal and/or vertical dovetail track or rail cut on the front or rear edge of the riser 104 for receiving the bow accessory coupler 108.

Figure 9:
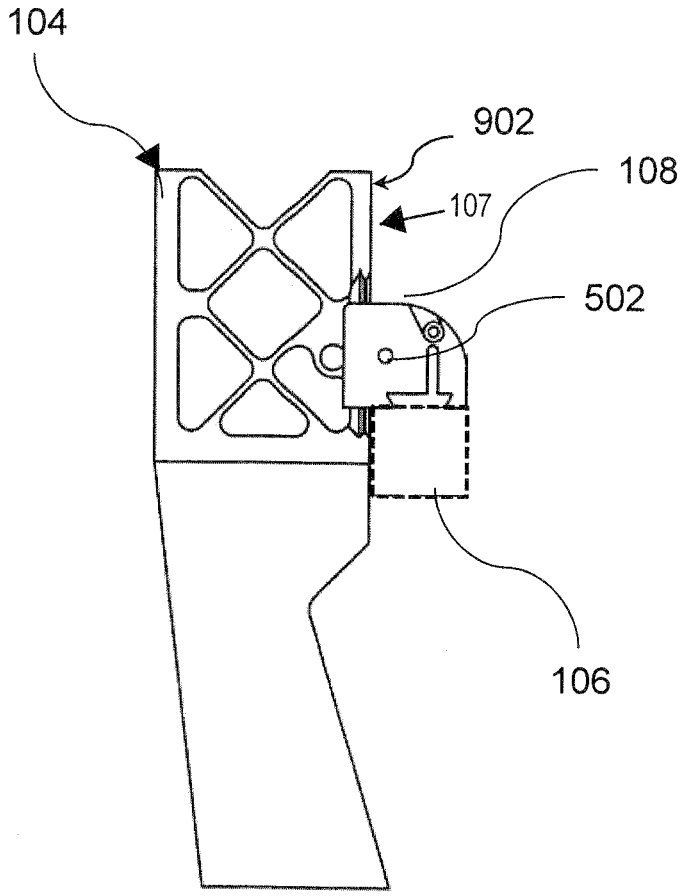
FIG. 9 is a side view of the archery bow riser of FIG. 6 having an embodiment of an accessory mount coupled thereto.
Figure 10:
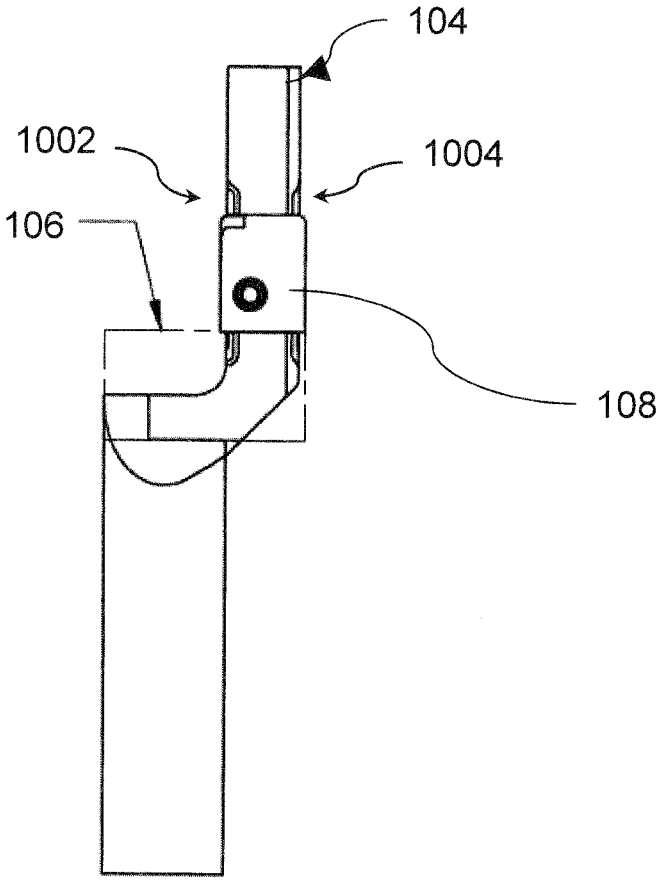
FIG. 10 is a front view of the archery bow riser of FIG. 9 having an embodiment of an accessory mount coupled thereto.
Figure 11:
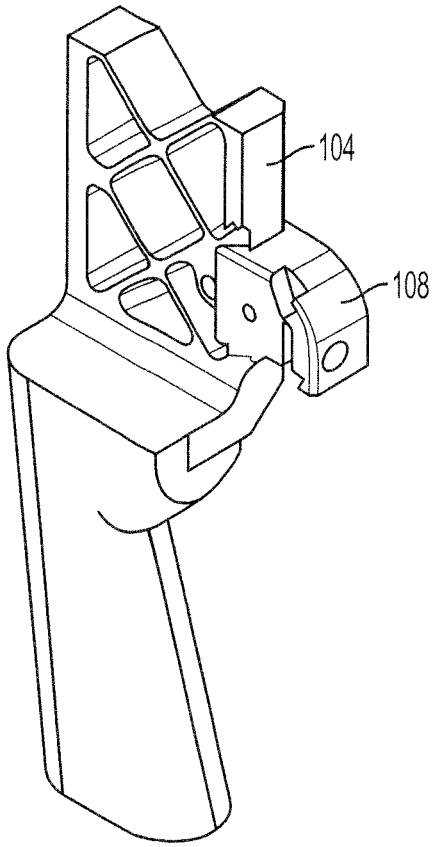
FIG. 11 is an isometric view of the archery bow riser of FIG. 9 having an embodiment of an accessory mount coupled thereto.
Figure 12:
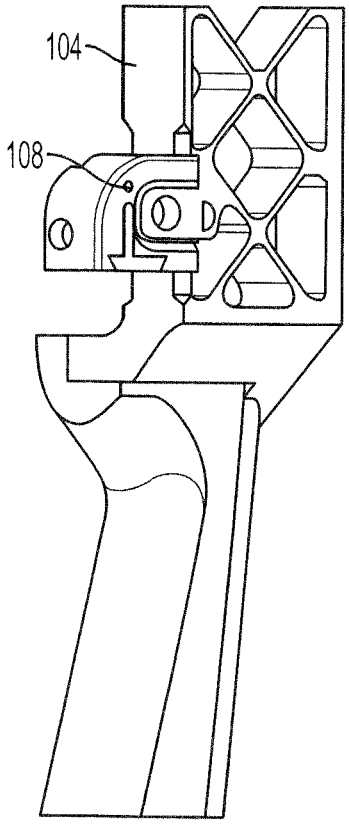
FIG. 12 is another isometric view of the archery bow riser of FIG. 11 having the embodiment of an accessory mount coupled thereto.

In the example illustrated by FIGS. 9-11, the bow accessory coupler 108 is configured to attach to the rear edge or rear side 107 of the riser 104 to couple the accessory 106 to the riser 104. The bow accessory coupler 108 secures the accessory 106 to the riser 104, for example, using a slip fit, press fit, snap fit, clamp fit or friction fit, to the riser 104. For example, the first and second riser engagers 504 and 506 can be placed on either side 1002, 1004 or either front or rear edge of the riser 104 and engage the riser 104, such as by tightening a fastener to clamp the first riser engager 504 and the second riser engager 506 together on the riser 104. In an example, the bow accessory coupler 108 is secured to a rear face or rear edge 902 of the riser 104. The slide-based cooperation between the coupler 108 and the dovetail-shaped rail 120 enables the user to slideably set the desired vertical position and then slideably adjust the vertical position for a new, desired setting, such as by slidably adjusting the vertical position. This configuration, in an embodiment, limits the movement to a vertical travel path relative to vertical axis 153 (FIG. 1), thereby eliminating undesirable degrees of freedom. The receipt of the elongated dovetail-shaped rail 120 by the coupler 108 stabilizes and secures the fixed position of the coupler 108 on the bow along the longitudinal and lateral axis of the riser 104. This can prevent the bow accessory coupler 108 from rotating, twisting or becoming misaligned along any axis of the riser 104 when subject to vibration, use, external forces, transportation or wear of the bow 102.

Depending upon the embodiment, any of the rails described herein can extend along the longitudinal axis of the bow 102, or such rail can extend along a lateral axis perpendicular to the bow's longitudinal axis. The rail extending along the longitudinal axis enables the user to adjust the vertical position of the accessory 106 relative to vertical axis 153. The rail extending along the lateral axis enables the user to adjust the lateral or left-to-right position of the accessory 106.

Figure 14:
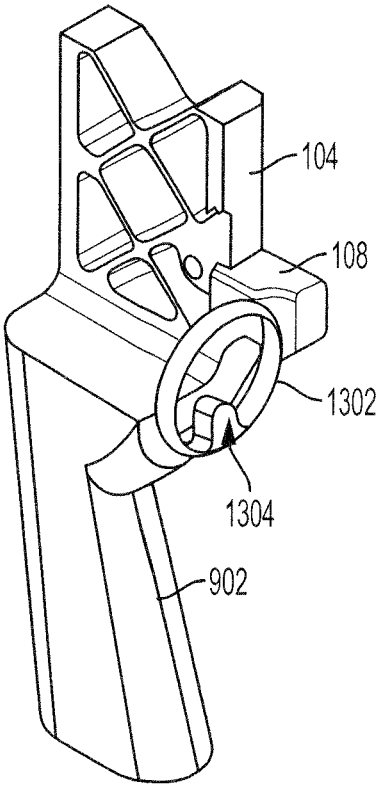
FIG. 14 is an isometric view of an archery bow riser having an embodiment of an arrow rest coupled thereto by an embodiment of an accessory mount.

In an embodiment, illustrated by FIGS. 13-14, the accessory 106 is an arrow rest 1302. The arrow rest 1302 is coupled, removably or permanently, to an bow accessory coupler 108. For example, the arrow rest 1302 is coupled to a rear edge 902 of a riser 104 via the bow accessory coupler 108, such as via a clamping force. The arrow holder 1304 is positioned at, or in line with, the center 1306 of the rear edge 902. When the archer places the arrow (not shown) in the arrow holder 1304, the arrow weight acts downward.

Accordingly, the archer's upward grasp or grasp force is substantially in line with, or in line with, the downward arrow force or weight acting on the arrow holder 1304. By centering the arrow rest 1302, or any other type of accessory, at the rear edge 902 of the riser, the weight of the accessory 1302 does not urge the bow 102 to lean or tip to the right or to the left. In addition, with the arrow rest 1302 positioned on the rear edge 902 of the riser 104, the accessory is better placed for user access.

The bow accessory coupler 108 is configured to attach bow-related accessories directly to a bow riser or other portion of a bow, eliminating the need for a separate mounting bracket or arm. Because less pieces are utilized to attach accessories, the overall weight and complexity of the accessorized bow assembly is reduced. The bow accessory coupler 108 attaches accessories to the bow riser via a secure method as described above. In addition, accessories that require a specific orientation, e.g. horizontal, vertical, etc., can be fixed at that orientation with little or no risk of the angular orientation changing while slide adjustments to the accessory position are made. Thus, the bow accessory coupler 108 allows a degree of slide adjustment along an axis while the accessory's orientation in other directions remains unchanged.

The bow 102 can have different configurations of its accessory coupling structure. For example, the accessory coupling structure 100 extends along a longitudinal axis of the bow 102, enabling a vertical repositioning when the bow 102 is held upright. In another embodiment not shown, the bow's accessory coupling structure extends along a horizontal axis of the bow 102, enabling a horizontal repositioning when the bow 102 is held upright. Accordingly, depending upon the embodiment, the bow 102 and coupler 108 can cooperate to enable reliable repositioning of bow accessories vertically or horizontally, such as by slide-based repositioning.

Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The following is claimed:

1. An archery accessory coupler comprising:
an accessory support configured to support an accessory;
a body coupled to the accessory support, wherein the body comprises a body portion configured to cooperate with first and second surfaces of a bow riser of an archery bow, wherein, when the archery bow is vertically oriented:
the bow riser extends along a vertical axis; and
each of the first surface, the second surface and the body portion extends along the vertical axis; and
a fastener,
wherein the first surface extends along a first plane,
wherein the second surface extends along a second plane,
wherein the body portion defines a channel that extends along a channel axis,
wherein, when the body portion is coupled to the bow riser and the archery bow is vertically oriented:
the channel axis extends laterally and intersects with the first and second planes,
in an adjustment condition, the body portion is configured to be slid along the vertical axis between a plurality of positions, and
in a securing condition, the fastener is configured to be at least partially inserted into the channel to apply a securing force that acts along the channel axis.

2. The archery accessory coupler of claim 1, wherein the body portion defines a plurality of flexible engagers that are spaced apart from each other so as to define an opening, wherein the opening is configured to at least partially receive the first and second surfaces, wherein the securing force comprises a squeezing force that squeezes the flexible engagers onto the first and second surfaces.

3. The archery accessory coupler of claim 1, wherein the body portion defines a plurality of flexible engagers that are spaced apart from each other, wherein the flexible engagers are configured to be at least partially inserted into an opening between the first and second surfaces, wherein the force comprises a pressing force that presses the flexible engagers against the first and second surfaces.

4. An archery accessory coupler comprising:
an accessory support configured to support an accessory;
a body coupled to the accessory support, wherein the body comprises a body portion configured to slideably cooperate with first and second slide surfaces of a bow riser of an archery bow, wherein, when the archery bow is vertically oriented:
the bow riser extends along a vertical axis; and
each of the first slide surface, the second slide surface and the body portion extends along the vertical axis,
wherein the first slide surface extends along a first plane,
wherein the second slide surface extends along a second plane,
wherein the body portion defines a channel that extends along a channel axis,
wherein the channel axis intersects with the first and second planes when the body portion is coupled to the bow riser and the archery bow is vertically oriented.

5. The archery accessory coupler of claim 4, comprising a fastener configured to be at least partially inserted into the channel.

6. The archery accessory coupler of claim 5, wherein the fastener is configured to apply a force that acts along the channel axis.

7. The archery accessory coupler of claim 6, wherein the body portion defines a plurality of flexible engagers that are spaced apart from each other so as to define an opening, wherein the opening is configured to at least partially receive the first and second slide surfaces, wherein the force comprises a squeezing force that squeezes the flexible engagers onto the first and second slide surfaces.

8. The archery accessory coupler of claim 6, wherein the body portion defines a plurality of flexible engagers that are spaced apart from each other, wherein the flexible engagers are configured to be at least partially inserted into an opening between the first and second slide surfaces, wherein the force comprises a pressing force that presses the flexible engagers against the first and second slide surfaces.

9. A method for manufacturing an archery accessory coupler, the method comprising:

structuring an accessory support so that the accessory support is configured to support an accessory;

structuring a body so that:

the body is configured to be coupled to the accessory support;

the body comprises a body portion configured to slideably cooperate with first and second slide surfaces of a bow riser of an archery bow, wherein, when the archery bow is vertically oriented: (a) the bow riser extends along a vertical axis; and (b) each of the first slide surface, the second slide surface and the body portion extends along the vertical axis;

the first slide surface extends along a first plane;

the second slide surface extends along a second plane;

the body portion defines a channel that extends along a channel axis; and the channel axis intersects with the first and second planes when the body portion is coupled to the bow riser and the archery bow is vertically oriented.

* * * * *